United States Patent [19]

Schreiber et al.

[11] Patent Number: 4,785,773

[45] Date of Patent: Nov. 22, 1988

[54] CYLINDER HEAD FOR A WATER-COOLED INTERNAL COMBUSTION ENGINE

[75] Inventors: Klaus-Hagen Schreiber, Meine/Wedelheine; Dieter Pundt, Calberlah, both of Fed. Rep. of Germany

[73] Assignee: Volkswagen AG, Fed. Rep. of Germany

[21] Appl. No.: 883,363

[22] Filed: Jul. 7, 1986

[30] Foreign Application Priority Data

Jul. 6, 1985 [DE] Fed. Rep. of Germany ..... 3524217

[51] Int. Cl.[4] ..... F02F 1/42

[52] U.S. Cl. ..... 123/193 H; 123/193 CH

[58] Field of Search ..... 123/195 C, 193 H, 96.38, 123/196 M, 196 AB, 41.82, 90.27, 41.42, 193 CH, 668, 669

[56] References Cited

U.S. PATENT DOCUMENTS

| | | | |
|---|---|---|---|
| 3,096,750 | 7/1963 | Bouvy et al. | 123/90.27 |
| 4,167,207 | 9/1979 | Rao et al. | 123/193 H |
| 4,300,494 | 11/1981 | Graiff et al. | 123/193 H |
| 4,676,064 | 6/1987 | Narita et al. | 123/193 H |

FOREIGN PATENT DOCUMENTS

| | | | |
|---|---|---|---|
| 287502 | 8/1928 | United Kingdom | 123/41.42 |

*Primary Examiner*—Willis R. Wolfe, Jr.
*Assistant Examiner*—M. Macy
*Attorney, Agent, or Firm*—Spencer & Frank

[57] ABSTRACT

A cylinder head for a water-cooled internal combustion engine has a lower and an upper cylinder head portion fitting over one another along a parting plane traversing cooling chambers complementally formed in the lower and upper cylinder head portions. The lower cylinder head portion has intake and exhaust ports and is tightened to a cylinder block. The upper cylinder head portion carries a valve operating assembly of the engine. A cylinder head cover is situated above the upper cylinder head portion and covers the valve operating assembly. The lower cylinder head portion has a circumferential lower wall bounding a liquid-guiding chamber provided in the lower cylinder head portion and serving for returning oil from the upper cylinder head portion. The lower cylinder head portion also has a circumferential upper wall constituting an upward continuation of the lower wall and extending from the intake and exhaust ports. The circumferential upper wall has a circumferential seating face supporting the cylinder head cover. The upper cylinder head portion is not in a direct contact with the cylinder head cover.

4 Claims, 1 Drawing Sheet

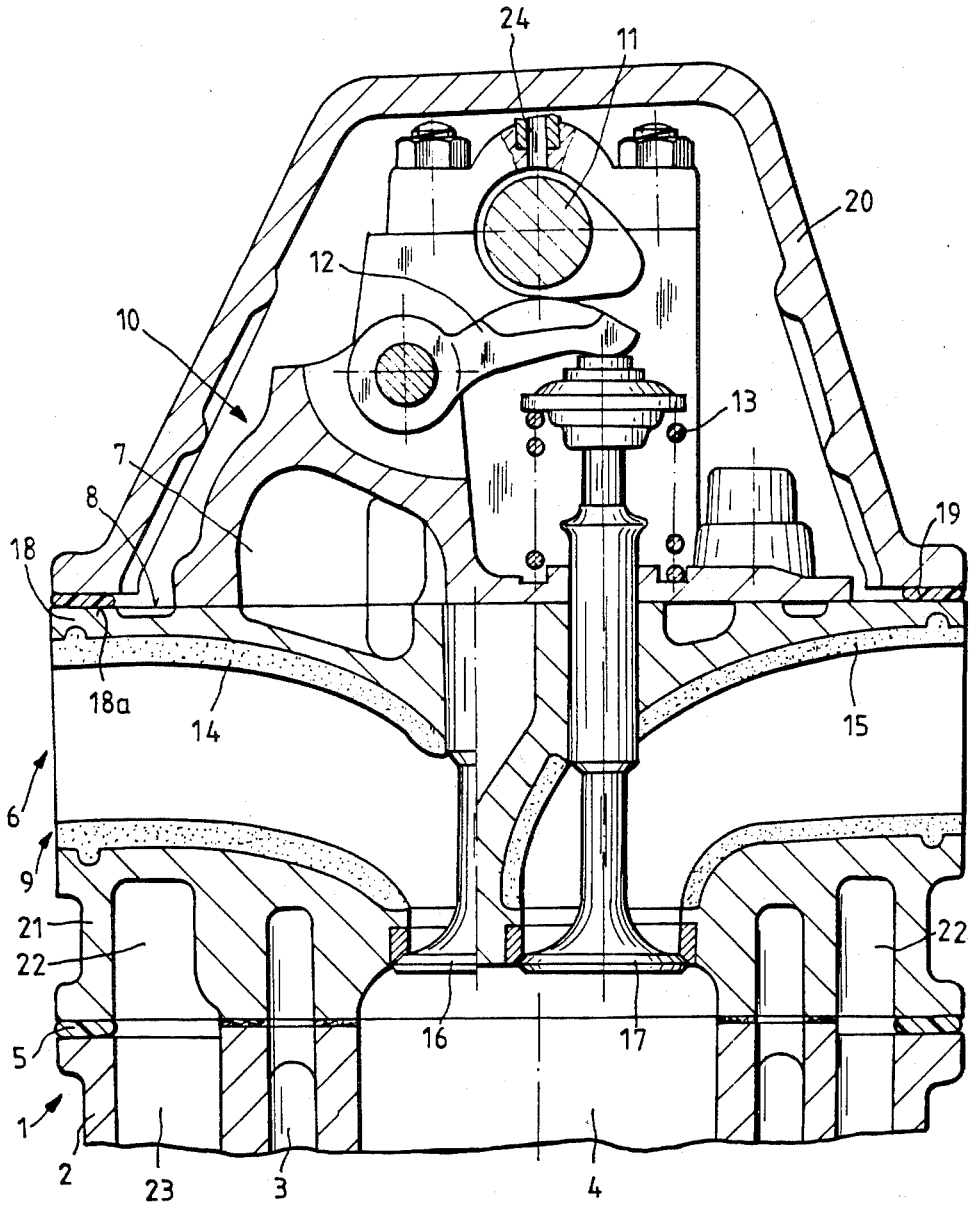
24
11
20
12
10
13
7
8
19
18
18a
14
15
6
9
21
22
22
16
17
5
1
2
23
3
4

CYLINDER HEAD FOR A WATER-COOLED INTERNAL COMBUSTION ENGINE

BACKGROUND OF THE INVENTION

This invention relates to a cylinder head for a water-cooled internal combustion engine. The cylinder head is divided into an upper cylinder head portion receiving the valve operating assembly and a lower cylinder head portion in which the intake and exhaust ports are formed. The parting plane between the two head portions extends generally horizontally and intersects coolant chambers, whereby the head portions are manufactured such that the coolant chambers formed therein are open at the bounding faces which, in the installed state, lie in the parting plane. One of the head portions is provided with a circumferential seating face for a cylinder head cover (rocker cover) which conceals the valve operating assembly. The lower head portion has walls which have lower engagement faces tightenable against the cylinder block and which bound liquid chambers. Further, these walls extend exclusively from the intake and exhaust ports.

A horizontally divided cylinder head of the above type is known and is disclosed, for example, in German Gebrauchsmuster (utility model patent) No. 1,894,505 wherein the parting plane passes through the coolant chambers. Such an arrangement has manufacturing advantages, for example, for a die casting process and makes the use of molds and cores particularly simple.

In the known cylinder head disclosed in the above patent the upper head portion carries the usual cylinder head cover on an upwardly projecting collar, while the lower head portion has one downwardly extending wall on one side and two downwardly extending walls on the other side. These three walls are adapted to engage corresponding counter walls of the cylinder block and bound the coolant chambers or channels.

For reducing the operational noise emanating from the combustion chambers and from the valve operating assembly, it is known to surround the internal combustion engine with a capsule which usually is formed of plurality of separate wall portions. In such an encapsulated engine it is known, as disclosed, for example, in Austrian Pat. No. 350,855, to insert sound insulating intermediate components into the intake and exhaust ports in order to reduce the sound emission also from the intake and exhaust ports which pass through the capsule without contacting the same. A capsule of such a type, however, requires a substantial structural space which is only rarely available under the hood of automotive vehicles.

SUMMARY OF THE INVENTION

It is an object of the invention to provide a two-part cylinder head of the earlier-outlined type which, while observing manufacturing advantages of the prior art constructions, is optimally sound suppressing, while dispensing with the use of a separate capsule.

This object and others to become apparent as the specification progresses, are accomplished by the invention, according to which, briefly stated, the seating face for the cylinder head cover is an integral component of the lower head portion and is formed on an upper wall thereof bounding the intake and exhaust ports from above and constituting a continuation of an outer circumferential lower wall of the lower head portion. The lower wall bounds a liquid chamber serving exclusively for oil return from the upper head portion. Further, the upper head portion is accommodated substantially in its entirety in the space enclosed by the cylinder head cover without being in contact with the latter.

The invention thus solves the earlier-described problem in a technologically simple manner without any additional spatial requirement in that in addition to the walls required to define the water channels and chambers, the lower head portion has an additional outer wall which defines a space required for guiding oil between the valve operating assembly and the cylinder block and which is connected with the lower head portion proper only via the intake and exhaust ports. The sound insulating effect achieved by this arrangement can be further enhanced by providing that the intake and exhaust ports and thus the mechanical connection between the outer wall and the lower head portion proper are made of a sound insulating material such as grey cast iron or ceramic. The upper head portion which, in essence, contains the valve operating assembly (the cam shaft, the rockers, the valve stems and the valve closing springs) is in contact with the outer wall of the lower head portion exclusively via the intake and exhaust ports and is at the top and on the sides concealed by the cylinder head cover. The latter is, on the one hand, secured to the circumferential seating face on the lower head portion with the interposition of a sound insulating gasket and is, on the other hand, of a poor sound conducting structure, as disclosed in German Offenlegungsschrift (non-examined published application) No. 2,948,572.

Thus, the outer wall of the lower cylinder head portion serves not only for sound insulation but also takes part in defining the required paths for the oil which thus flows around the intake and exhaust ports. It is noted in this connection that German Offenlegungsschrift No. 3,123,527 to which corresponds U.S. Pat. No. 4,606,304, describes an internal combustion engine having coolant oil chambers where the oil, constituting the sole coolant, streams through an intermediate space between the internal combustion engine proper and a housing provided with cooling ribs, thus exposing the intake and exhaust ports to the cooling oil flow. That structure, however, concerns an internal combustion engine operating with a sole liquid which simultaneously serves for lubrication and for cooling and does not use a cylinder head divided according to the invention. It is a purpose of the construction disclosed in the above United States patent to provide an oil-cooled internal combustion engine whose engine block is a one-piece cast component (that is, the cylinder head and the cylinder block constitute an integral, one-piece construction) which, when viewed vertically, extends from the level of the crankshaft bearings up to and including the valve operating assembly.

BRIEF DESCRIPTION OF THE DRAWING

The sole FIGURE is a sectional end elevational view of a preferred embodiment of the invention.

DESCRIPTION OF THE PREFERRED EMBODIMENT

Turning now to the Figure, there is shown the upper part of a cylinder block 1 which has an outer wall 2 and in which there are formed the cooling water jacket 3 and cylinders 4 (only one shown). On the top of the cylinder block 1, there is placed, with the interposition of a conventional cylinder head gasket 5, a cylinder head 6 which is divided along a parting plane 8, passing transversely through cooling water chambers and channels 7, into a lower cylinder head portion 9 and an upper cylinder head portion 10. Such a division of the cylinder head has the advantage that undercut portions or closed cavities in the cast cylinder head may be avoided; these would involve difficulties in the shaping of the cylinder head.

The upper head portion 10 includes in essence the valve operating assembly, that is, the cam shaft 11, rockers 12 and valve closing springs 13 as well as the associated bearings. The principal components of the lower head portion 9 are the intake and exhaust ports 14 and 15, respectively, which in the described embodiment are made of a poor heat and sound conductor such as ceramic. With each cylinder 4 there are associated intake and exhaust valves 16 and 17, respectively, which control the intake and exhaust ports 14 and 15.

The intake and exhaust ports 14 and 15 are bounded by an upper peripheral wall 18 which forms an integral part of the lower head portion 9 and whose outer, upwardly oriented surface constitutes a seating face 18*a* which carries a cylinder head cover (rocker cover) 20 with the interposition of a gasket 19 having sound insulating properties. The cylinder head cover 20 conceals the upper head portion 10 without being in a direct mechanical contact therewith and thus without providing a solid sound conducting bridge. The cylinder head cover 20 surrounds the upper head portion 10 at the top and on all sides.

The upper wall 18 of the lower head portion 9 is an upward continuation of a lower, outer circumferential wall 21 which, although part of the lower head portion 9, is connected with the inner, major zone thereof only with the intermediary of the intake and exhaust ports 14 and 15 (designed to be sound suppressing) and defines a intermediate space 22. The lower, outer circumferential wall 21 is supported on the outer wall 2 of the cylinder block 1. The intermediate space 22 is adjoined by a space 23 formed in the cylinder block 1 externally of the water jacket 3 and serves, jointly with the space 23, for the return of the oil—after the latter lubricates the valve operating assembly—in front of and behind the mid zones of the intake and exhaust ports 14, 15, as viewed in the Figure. A lubricating channel at the bearing of the cam shaft 11 is designated at 24.

The invention thus provides a cylinder head for an internal combustion engine which has the favorable, sound insulating properties of a conventional, encapsulated internal combustion engine without the spatial requirements for an additional capsule.

It will be understood that the above description of the present invention is susceptible to various modifications, changes and adaptations, and the same are intended to be comprehended within the meaning and range of equivalents of the appended claims.

What is claimed is:

1. In a cylinder head for a water-cooled internal combustion engine, including a lower cylinder head portion and an upper cylinder head portion fitting over the lower cylinder head portion along a parting plane traversing cooling chambers complementally formed in the lower and upper cylinder head portions; said lower cylinder head portion having intake and exhaust ports and walls extending exclusively from said intake and exhaust ports; said walls having engagement faces for being tightened to a cylinder block of the engine; said walls bounding liquid-guiding chambers formed in said lower cylinder head portion; said upper cylinder head portion carrying a valve operating assembly of the engine; the cylinder head further having a cylinder head cover situated above the upper cylinder head portion and covering said valve operating assembly; the improvement wherein said lower cylinder head portion has a circumferential lower wall bounding a liquid-guiding chamber provided in said lower cylinder head portion and serving exclusively for returning oil from said upper cylinder head portion; and a circumferential upper wall constituting an upward continuation of said circumferential lower wall and extending from said intake and exhaust ports; said circumferential upper wall having a circumferential seating face supporting said cylinder head cover and constituting the sole support therefor; said upper cylinder head portion being out of contact with said cylinder head cover and being accommodated substantially in its entirety in a space surrounded by said cylinder head cover.

2. A cylinder head as defined in claim 1, wherein said intake and exhaust ports are defined by walls of sound insulating material.

3. A cylinder head as defined in claim 2, wherein said sound insulating material is grey cast iron.

4. A cylinder head as defined in claim 2, wherein said insulating material is a ceramic.

* * * * *